US005771977A

United States Patent [19]

Schmidt

[11] Patent Number: 5,771,977

[45] Date of Patent: Jun. 30, 1998

[54] AUTOMATIC TRIGGER MECHANISM FOR PORTABLE FIRE EXTINGUISHERS

[75] Inventor: Robert A. Schmidt, 3335 North Branch Rd., North Branch, Mich. 48461

[73] Assignee: Robert A. Schmidt, Lapeer, Mich.

[21] Appl. No.: 767,302

[22] Filed: Dec. 16, 1996

[51] Int. Cl.[6] ..... A62C 13/76

[52] U.S. Cl. ..... 169/26; 169/89

[58] Field of Search ..... 169/26, 89, 42, 169/65

[56] References Cited

U.S. PATENT DOCUMENTS

| | | | |
|---|---|---|---|
| 2,139,634 | 12/1938 | Heigis | 169/26 |
| 2,519,350 | 8/1950 | Cahusac | 169/26 |
| 3,316,974 | 5/1967 | Cholin | 169/26 |
| 3,536,139 | 10/1970 | Berti et al. | 169/26 |
| 3,613,793 | 10/1971 | Kuthsing | 169/26 |
| 3,719,231 | 3/1973 | Haggard | 169/89 |
| 3,768,567 | 10/1973 | Weise | 169/26 |
| 3,915,236 | 10/1975 | Stichling | 169/26 |
| 4,256,181 | 3/1981 | Searcy | 169/65 |
| 4,265,316 | 5/1981 | Fee | 169/26 |
| 4,718,498 | 1/1988 | Davios . | |
| 4,872,513 | 10/1989 | Gardner et al. . | |
| 4,997,046 | 3/1991 | Evans . | |
| 5,297,636 | 3/1994 | North | 169/65 |
| 5,458,201 | 10/1995 | Brim . | |

*Primary Examiner*—Gary C. Hoge

[57] ABSTRACT

An adapter is mountable to a trigger mechanism of a conventional fire extinguisher to form a portable automatic fire extinguisher. The adapter comprises a compressed spring held in place with a heat release fusible link. If fire occurs in the vicinity of the adapter, the fusible link separates allowing the compression spring to depress the fire extinguisher trigger mechanism.

1 Claim, 2 Drawing Sheets

AUTOMATIC TRIGGER MECHANISM FOR PORTABLE FIRE EXTINGUISHERS

BACKGROUND OF THE INVENTION

1. Field of the Invention

This invention relates in general to fire extinguishers and in particular to automatic fire extinguishers.

2. Description of the Prior Art

There are many types of fire extinguishers including portable hand held fire extinguishers and those built into buildings. Portable hand-held fire extinguishers generally have a canister filled with a pressurized fluid. The valve assembly is located atop the canister and can be manually operated to release the pressurized fluid. A hose or nozzle is used to direct the spray of pressurized fluid from the canister.

Fire extinguishers built into buildings include a source of pressurized fluid, such as water, and a conduit system which is in fluid communication with automatic sprinkler heads which are generally located adjacent to ceilings in the buildings. The automatic sprinkler heads often include fusible links or members which are heat sensitive and are used to control the release of the pressurized fluid during a fire.

The built-in fire extinguisher systems in buildings have a number of faults. First of all, these systems are expensive to install. Second, as these systems are built into the buildings, they can be difficult and expensive to later modify to provide fire protection in a newly specified area. For example, additional fire protection may be needed in the area of a newly installed computer system or adjacent a Christmas tree.

An automatic trigger mechanism attached to a portable fire extinguisher could be used in several fire risk areas including: cooking ranges, marine engine compartments, automotive engine compartments, engine dynamometer test cells, and any area within a building where additional fire protection may be needed.

In order to provide background information so that the invention may be completely understood and appreciated in its proper context, reference is made to a number of prior art patents. U.S. Pat. No. 4,872,513 of Gardner et al, and U.S. Pat. No. 5,458,201 of Brim uses a conventional automatic sprinkler head attached to a portable fire extinguisher. The problem with this approach is that the trigger has to be depressed in order to pressurize the line between the sprinkler head and the extinguishers pressurized cylinder. The line has to be of a construction to be able to withstand the extinguishers cylinder pressure.

U.S. Pat. No. 4,718,498 of Davios uses a flame sensing device to supply current to an electromagnet to release the fire extinguishers contents. This approach adds considerable cost to the fire extinguisher.

The present invention is intended to overcome the above described shortcomings of conventional hand-held fire extinguishers, built-in fire protection systems, and automatic sprinkler heads.

SUMMARY OF THE INVENTION

A fire extinguisher adapter is provided which mates with conventional fire extinguishers having a canister filled with pressurized fluid and a valve assembly with a release mechanism for controlling the flow of fluid from the canister. The adapter is attached to the valve assembly and comprises a compression spring, a heat release fusible link and a means for transferring the spring force to the extinguishers trigger during a fire. The heat release fusible link keeps the spring compressed until it is exposed to heat from a fire where it in turn separates and allows the spring to force the trigger against the stationary handle resulting in the release of the extinguishers contents.

The present invention further includes a guide for the connecting means to minimize cocking of the spring when the link separates. The spring provides sufficient force to overcome the force required to activate the fire extinguishers trigger. The adapter is made of materials that can withstand fire for the period of time required to activate the extinguisher.

It is an object of the present invention to provide an adapter for a conventional hand-held fire extinguisher which connects to the trigger mechanism to provide a stand alone automatic fire extinguisher system which can be transported from room to room, or adapted to a cooking range hood, marine engine compartment, or automotive engine compartment.

This and other objects, features, and advantages will become readily apparent from the following description and accompanying sheets of drawings.

DESCRIPTION OF THE PREFERRED EMBODIMENTS

Figure 1:
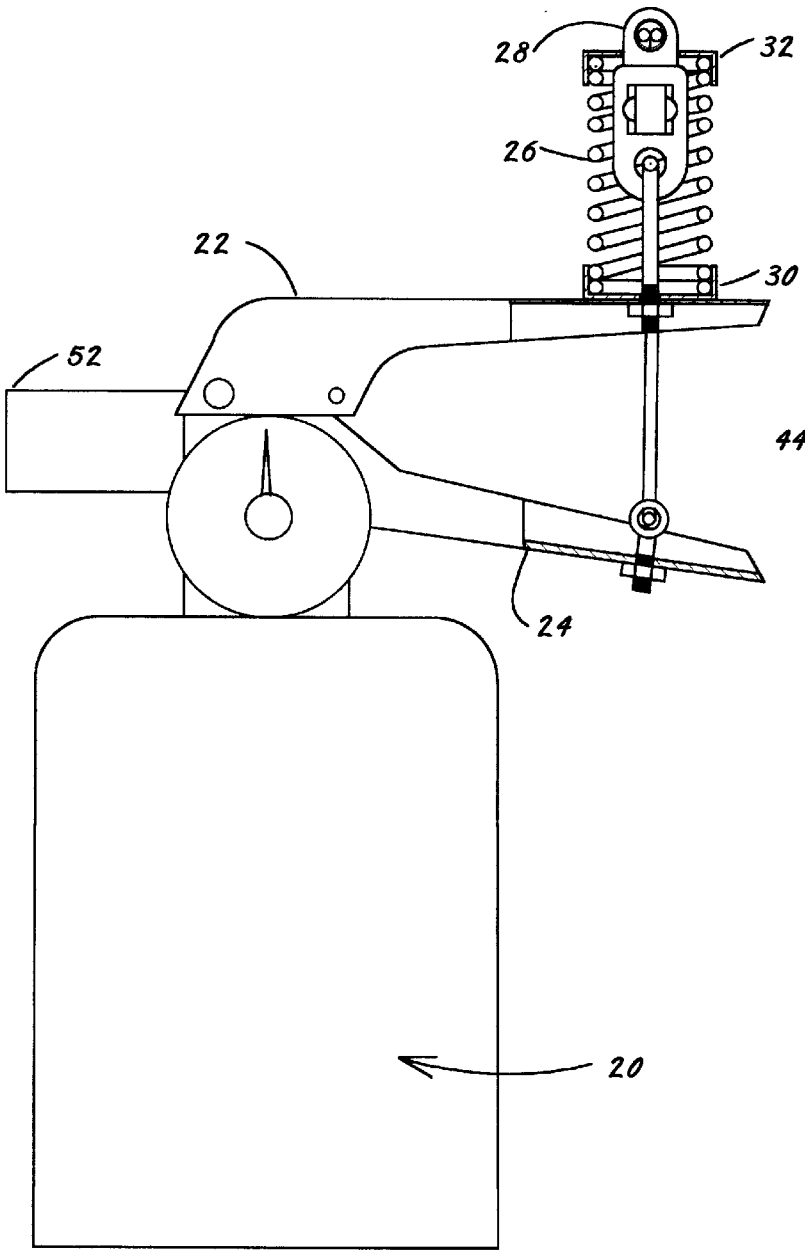
FIG. 1 is a side elevational view, in partial cutaway, of a hand held fire extinguisher with an adapter made in accordance with the present invention.
Figure 2:
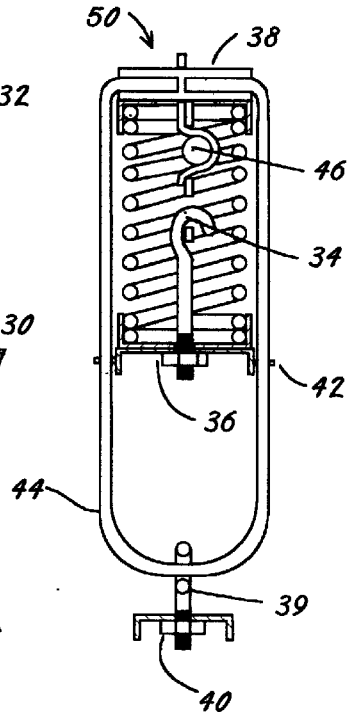
FIG. 2 is a side elevational view of the adapter with the spring under compression held in place by the fusible link.
Figure 3:
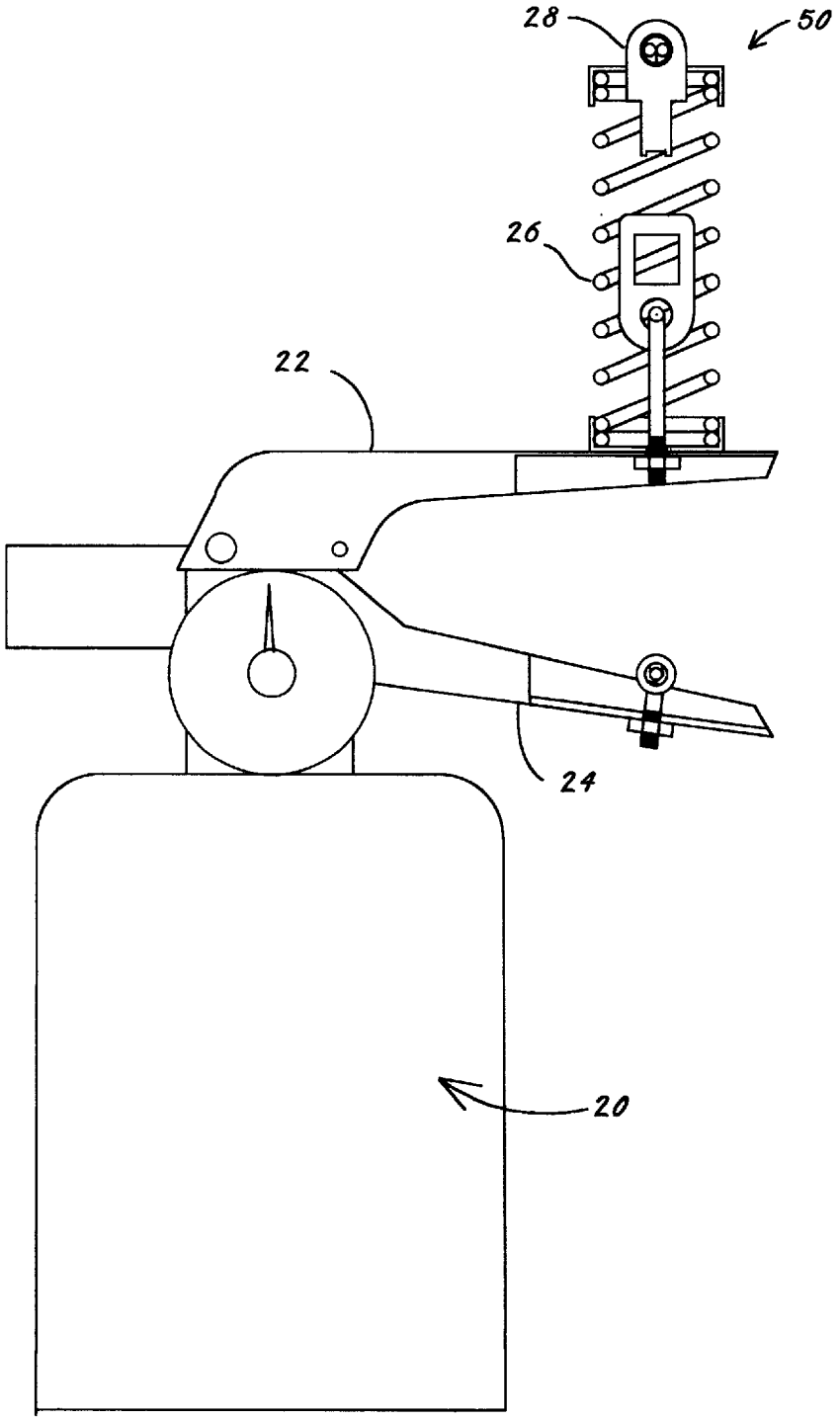
FIG. 3 is a side elevational view of the adapter showing the fusible link released and the spring forcing the trigger down.

The main sections and parts of the invention are described on the basis of the indicative example below wherein the item numbering corresponds to the drawing.

A fire extinguisher adapter 50, made in accordance with the present invention, is shown in FIG. 1. The adapter 50 is mountable to a portable hand-held fire extinguisher 20 to create a portable automatic fire extinguisher assembly.

Adapter 50 comprises a spring 26, a heat release fusible link 28, a spring bottom cap 30, a spring top cap 32, a retention tube 38, and a hook bolt 34 that is attached to the moveable trigger arm 22 of the fire extinguisher 20. A nut 36 is used to retain the hook bolt 34 to the trigger arm 22. The adapter must be made of materials that are capable of withstanding a fire for the time required to melt the heat sensitive coupling 46.

A coupling wire 44 is used to connect the top of the heat release fusible link 28 to the stationary arm 24 of the fire extinguisher 20. An eyelet bolt 39 is connected to the stationary arm 24 by a nut 40. The coupling wire 44 is attached to the eyelet bolt 39. The coupling wire 44 is held in place on the moveable trigger arm 22 with two guides 42. The guides 42 keep the spring 26 from cocking when the fusible link 28 releases.

Fire 3. shows the fire extinguisher adapter in the activated stage. When the fire extinguisher adapter 50 is exposed to fire, the heat sensitive coupling 46 melts at a predetermined temperature and the fusible link 28 separates from the load of the spring 26. The spring 26 uncompresses and forces the moveable trigger 22 against the stationary trigger 24. This causes the fire extinguisher 20 to discharge its contents out of the nozzle 52. An attachment can be made to the nozzle 52 to direct and distribute the extinguishers contents to the required area. The portable hand held fire extinguisher 20 must be made of materials that are capable of withstanding a fire for the time required to melt the heat sensitive coupling 46.

The spring 26 must have sufficient force and extension to force the moveable trigger 22 toward the stationary trigger 24, but not too much force to separate the fusible link 28 prematurely. The inner diameter of the spring 26 must be sized to guide the fusible link 28 without restricting movement.

The hole through the bottom cap 30 centers the hook bolt 34 to the spring. The bottom cap 30 is cupped to center the spring to the hook bolt. The hole through the top cap 32 centers the top of the fusible link 28 to the spring. The top cap 32 is cupped to center the spring to the fusible link 28.

The retention tube 38 slides through the top of the fusible link 28 and provides attachment of the coupling wire 44. The tube must be made of a material that can take the load of the compression spring. The retention tube 38 can be crimped over the coupling wire 44 to keep the two components coupled when the adapter is activated.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An automatic fire extinguisher comprising:

a canister filled with a pressurized fluid;

a release mechanism mounted on said canister, said release mechanism comprising a fixed lever and a movable lever;

a heat responsive trigger mechanism comprising, a first cap member mounted to said movable lever, a spring operatively coupled with said first cap member at a first end thereof, a second cap member operatively coupled with a second end of said spring, a fusible link extending within said spring, said fusible link being coupled at a first end thereof to said first cap member, and at a second end to said second cap member, said fusible link holding said cap members a fixed distance apart, at which distance said spring is compressed, means for maintaining said second cap member a fixed distance from said fixed lever, whereby upon the failure of said fusible link, said spring will expand, forcing said cap members apart, and thereby forcing said movable lever toward said fixed lever, thus discharging said extinguisher.

* * * * *